US011341916B2

(12) United States Patent
Lee et al.

(10) Patent No.: US 11,341,916 B2
(45) Date of Patent: May 24, 2022

(54) DISPLAY APPARATUS HAVING VARIED DRIVING FREQUENCY AND GATE CLOCK SIGNAL

(71) Applicant: Samsung Display Co., Ltd., Yongin-Si (KR)

(72) Inventors: Hyo-Jin Lee, Yongin-si (KR); Sehyuk Park, Seongnam-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/973,459

(22) PCT Filed: May 31, 2019

(86) PCT No.: PCT/KR2019/006598
§ 371 (c)(1),
(2) Date: Dec. 9, 2020

(87) PCT Pub. No.: WO2019/245189
PCT Pub. Date: Dec. 26, 2019

(65) Prior Publication Data

US 2021/0248960 A1 Aug. 12, 2021

(30) Foreign Application Priority Data

Jun. 18, 2018 (KR) ..... 10-2018-0069586

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2300/08* (2013.01); *G09G 2310/08* (2013.01)

(58) Field of Classification Search
CPC ..... G09G 3/3258
USPC ..... 345/212
See application file for complete search history.

(56) References Cited

U.S. PATENT DOCUMENTS 9,501,993 B2 11/2016 Nambi et al.
2012/0169698 A1 7/2012 Park et al.
2013/0002641 A1* 1/2013 Kim ..... G09G 3/3685 345/212

(Continued)

FOREIGN PATENT DOCUMENTS

KR 10-2012-0077507 A 7/2012
KR 10-2015-0069591 A 6/2015

(Continued)

*Primary Examiner* — Long D Pham
(74) *Attorney, Agent, or Firm* — Innovation Counsel LLP

(57) ABSTRACT

A display apparatus includes a display panel, a gate driver, a data driver and an emission driver. The display panel includes a pixel comprising a switching element of a first type and a switching element of a second type different from the first type. The gate driver is configured to generate a gate signal based on a vertical start signal and a gate clock signal and output the gate signal to the display panel. The data driver is configured to output a data voltage to the display panel. The emission driver is configured to output an emission to the display panel. A driving frequency of the display panel is varied according to an input image. The gate clock signal has an active duration having a varied length according to the driving frequency.

17 Claims, 21 Drawing Sheets

(56) References Cited

U.S. PATENT DOCUMENTS

| | | | | |
|---|---|---|---|---|
| 2015/0049126 | A1* | 2/2015 | Jung | G09G 3/3233 345/690 |
| 2016/0210900 | A1* | 7/2016 | Kim | G09G 3/3233 |
| 2017/0206837 | A1* | 7/2017 | Jeon | G09G 3/3258 |
| 2018/0006099 | A1* | 1/2018 | Ka | H01L 27/1225 |
| 2018/0158407 | A1* | 6/2018 | Chai | G09G 3/3275 |
| 2019/0172379 | A1* | 6/2019 | Park | G09G 3/20 |

FOREIGN PATENT DOCUMENTS

| | | | |
|---|---|---|---|
| KR | 10-2016-0052942 | A | 5/2016 |
| KR | 10-2016-0086491 | A | 7/2016 |
| KR | 10-2017-0086761 | A | 7/2017 |
| KR | 10-2018-0025438 | A | 3/2018 |
| KR | 10-2018-0061524 | A | 6/2018 |
| WO | 2012165302 | A1 | 12/2012 |

* cited by examiner

FIG. 5

| DRIVING FREQUENCY | FLM Ontime | CLK Ontime |
|---|---|---|
| 60Hz | a | b |
| 30Hz | x1 · a | y1 · b |
| 20Hz | x2 · a | y2 · b |
| 10Hz | x3 · a | y3 · b |
| 2Hz | x4 · a | y4 · b |
| 1Hz | x5 · a | y5 · b |

FIG. 10

| DRIVING FREQUENCY | ELVDD |
|---|---|
| 60Hz | 4.6 |
| 30Hz | 4.4 |
| 20Hz | 4.3 |
| 10Hz | 4.2 |
| 2Hz | 4.1 |
| 1Hz | 4.0 |

FIG. 14

| DRIVING FREQUENCY | VGH |
|---|---|
| 60Hz | 7.0 |
| 30Hz | 7.1 |
| 20Hz | 7.2 |
| 10Hz | 7.3 |
| 2Hz | 7.4 |
| 1Hz | 7.5 |

DISPLAY APPARATUS HAVING VARIED DRIVING FREQUENCY AND GATE CLOCK SIGNAL

PRIORITY STATEMENT

This application claims priority under 35 U.S.C. § 119 to Korean Patent Application No. 10-2018-0069586, filed on Jun. 18, 2018 and PCT Application No PCT/KR2019/006598, filed on May 31, 2019 in the Korean Intellectual Property Office KIPO, the contents of which are herein incorporated by reference in their entireties.

BACKGROUND

1. Field

Example embodiments of the present inventive concept relate to a display apparatus. More particularly, example embodiments of the present inventive concept relate to a display apparatus reducing a power consumption and enhancing a display quality.

2. Description of the Related Art

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

When an image displayed on the display panel is a static image or the display panel is operated in always on mode, a driving frequency of the display panel may be decreased to reduce a power consumption.

When the driving frequency of the display panel is changed, a display quality may be deteriorated due to a luminance difference between images according to the driving frequency.

SUMMARY

Example embodiments of the present inventive concept provide a display apparatus capable of reducing a power consumption and enhancing a display quality.

In an example embodiment of a display apparatus according to the present inventive concept, the display apparatus includes a display panel, a gate driver, a data driver and an emission driver. The display panel includes a pixel comprising a switching element of a first type and a switching element of a second type different from the first type. The gate driver is configured to generate a gate signal based on a vertical start signal and a gate clock signal and output the gate signal to the display panel. The data driver is configured to output a data voltage to the display panel. The emission driver is configured to output an emission signal to the display panel. A driving frequency of the display panel is varied according to an input image. The gate clock signal has an active duration having a varied length according to the driving frequency.

In an example embodiment, as the driving frequency decreases, the length of the active duration of the gate clock signal may increase.

In an example embodiment, an active duration length of the vertical start signal may vary according to the driving frequency.

In an example embodiment, as the driving frequency decreases, the length of the active duration of the vertical start signal may increase.

In an example embodiment, the gate signal may include a data write gate signal. An active duration length of the data write gate signal may vary according to the driving frequency.

In an example embodiment, in a low frequency driving mode, the gate clock signal may swing between a high level and a low level in a writing frame when data is written to the pixel. In the low frequency driving mode, the gate clock signal may maintain the low level in a holding frame when the data written to the pixel is maintained.

In an example embodiment, in a low frequency driving mode, the gate clock signal may swing between a high level and a low level in a writing frame when data is written to the pixel. In the low frequency driving mode, the gate clock signal may maintain the high level in a holding frame when the data written to the pixel is maintained.

In an example embodiment, the switching element of the first type may be a polysilicon thin film transistor. The switching element of the second type may be an oxide thin film transistor.

In an example embodiment, the switching element of the first type may be a P-type transistor. The switching element of the second type may be an N-type transistor.

In an example embodiment, the pixel may include a first pixel switching element comprising a control electrode connected to a first node, an input electrode connected to a second node and an output electrode connected to a third node, a second pixel switching element comprising a control electrode to which a first data write gate signal is applied, an input electrode to which the data voltage is applied and an output electrode connected to the second node, a third pixel switching element comprising a control electrode to which a second data write gate signal is applied, an input electrode connected to the first node and an output electrode connected to the third node, a fourth pixel switching element comprising a control electrode to which a data initialization gate signal is applied, an input electrode to which an initialization voltage is applied and an output electrode connected to the first node, a fifth pixel switching element comprising a control electrode to which the emission signal is applied, an input electrode to which a high power voltage is applied and an output electrode connected to the second node, a sixth pixel switching element comprising a control electrode to which the emission signal is applied, an input electrode connected to the third node and an output electrode connected to an anode electrode of an organic light emitting element, a seventh pixel switching element comprising a control electrode to which an organic light emitting element initialization gate signal is applied, an input electrode to which the initialization voltage is applied and an output electrode connected to the anode electrode of the organic light emitting element, and a storage capacitor comprising a first electrode to which the high power voltage is applied and a second electrode connected to the first node. The organic light emitting element may include the anode electrode connected to the output electrode of the sixth pixel switching element and a cathode electrode to which a low power voltage is applied.

In an example embodiment, the first pixel switching element, the second pixel switching element, the fifth pixel switching element and the sixth pixel switching element may be the polysilicon thin film transistors. The third pixel switching element, the fourth pixel switching element and the seventh pixel switching element may be the oxide thin film transistors.

In an example embodiment, the pixel may include a first pixel switching element comprising a control electrode connected to a first node, an input electrode connected to a second node and an output electrode connected to a third node, a second pixel switching element comprising a control electrode to which a first data write gate signal is applied, an input electrode to which the data voltage is applied and an output electrode connected to the second node, a third pixel switching element comprising a control electrode to which a second data write gate signal is applied, an input electrode connected to the first node and an output electrode connected to the third node, a fourth pixel switching element comprising a control electrode to which a data initialization gate signal is applied, an input electrode to which an initialization voltage is applied and an output electrode connected to the first node, a fifth pixel switching element comprising a control electrode to which the emission signal is applied, an input electrode to which a high power voltage is applied and an output electrode connected to the second node, a sixth pixel switching element comprising a control electrode to which the emission signal is applied, an input electrode connected to the third node and an output electrode connected to an anode electrode of an organic light emitting element, a seventh pixel switching element comprising a control electrode to which the emission signal is applied, an input electrode to which the initialization voltage is applied and an output electrode connected to the anode electrode of the organic light emitting element, and a storage capacitor comprising a first electrode to which the high power voltage is applied and a second electrode connected to the first node. The organic light emitting element may include comprising the anode electrode connected to the output electrode of the sixth pixel switching element and a cathode electrode to which a low power voltage is applied.

In an example embodiment, the first pixel switching element, the second pixel switching element, the fifth pixel switching element, the sixth pixel switching element and the seventh pixel switching element may be the polysilicon thin film transistors. The third pixel switching element and the fourth pixel switching element may be the oxide thin film transistors.

In an example embodiment, a display panel driver may be configured to drive the switching element of the first type and the switching element of the second type in a high driving frequency in a high frequency driving mode. The display panel driver may be configured to drive the switching element of the first type and the switching element of the second type in a low driving frequency in a low frequency driving mode.

In an example embodiment, a display panel driver may be configured to drive the switching element of the first type and the switching element of the second type in a high driving frequency in a high frequency driving mode. The display panel driver may be configured to drive the switching element of the first type in the high driving frequency and the switching element of the second type in a low driving frequency less than the high driving frequency in a hybrid driving mode.

In an example embodiment of a display apparatus according to the present inventive concept, the display apparatus includes a display panel, a gate driver, a data driver and an emission driver. The display panel includes a pixel which includes a switching element of a first type and a switching element of a second type different from the first type. The gate driver is configured to output a gate signal to the display panel. The data driver is configured to output a data voltage to the display panel. The emission driver is configured to output an emission signal to the display panel. A driving frequency of the display panel is varied according to an input image. A high power voltage applied to the pixel may vary according to the driving frequency.

In an example embodiment, as the driving frequency decreases, the level of the high power voltage may decrease.

In an example embodiment, the high power voltage applied to the pixel may vary according to the driving frequency. The high power voltage may be gradually changed to the target level as time passes.

In an example embodiment of a display apparatus according to the present inventive concept, the display apparatus includes a display panel, a gate driver, a data driver and an emission driver. The display panel includes a pixel which includes a switching element of a first type and a switching element of a second type different from the first type. The gate driver is configured to output a gate signal to the display panel. The data driver is configured to output a data voltage to the display panel. The emission driver is configured to output an emission signal to the display panel. A driving frequency of the display panel may vary according to an input image. A gate on voltage defining a high level of the gate signal may vary according to the driving frequency.

In an example embodiment, as the driving frequency decreases, the level of the gate on voltage may increase.

According to the display apparatus, the gate clock signal having a varied activation duration length according to the driving frequency may be applied to the gate driver. Accordingly, the luminance difference between the images of the display panel according to the driving frequency may be compensated so that the display quality of the display panel may be enhanced.

In addition, the high power voltage having a varied level according to the driving frequency may be applied to the pixel. Accordingly, the luminance difference between the images of the display panel according to the driving frequency may be compensated so that the display quality of the display panel may be enhanced.

In addition, the gate on voltage having a varied level according to the driving frequency may be applied to the gate driver. Accordingly, the luminance difference between the images of the display panel according to the driving frequency may be compensated so that the display quality of the display panel may be enhanced.

Therefore, the display quality deterioration generated in the low frequency driving mode may be resolved so that the power consumption of the display apparatus may be reduced and the display quality of the display panel may be enhanced.

BRIEF DESCRIPTION OF THE DRAWINGS

FIG. 5 is a table illustrating an active duration of a vertical start signal and an active duration of a gate clock signal applied to a gate driver of FIG. 1 according to a driving frequency of the display panel of FIG. 1.

FIG. 10 is a table illustrating a level of a high power voltage applied to a pixel according to a driving frequency of a display panel according to an example embodiment of the present inventive concept.

FIG. 14 is a table illustrating a gate on voltage applied to a gate driver according to a driving frequency of a display panel according to an example embodiment of the present inventive concept.

DETAILED DESCRIPTION OF THE INVENTIVE CONCEPT

Hereinafter, the present inventive concept will be explained in detail with reference to the accompanying drawings.

Figure 1:
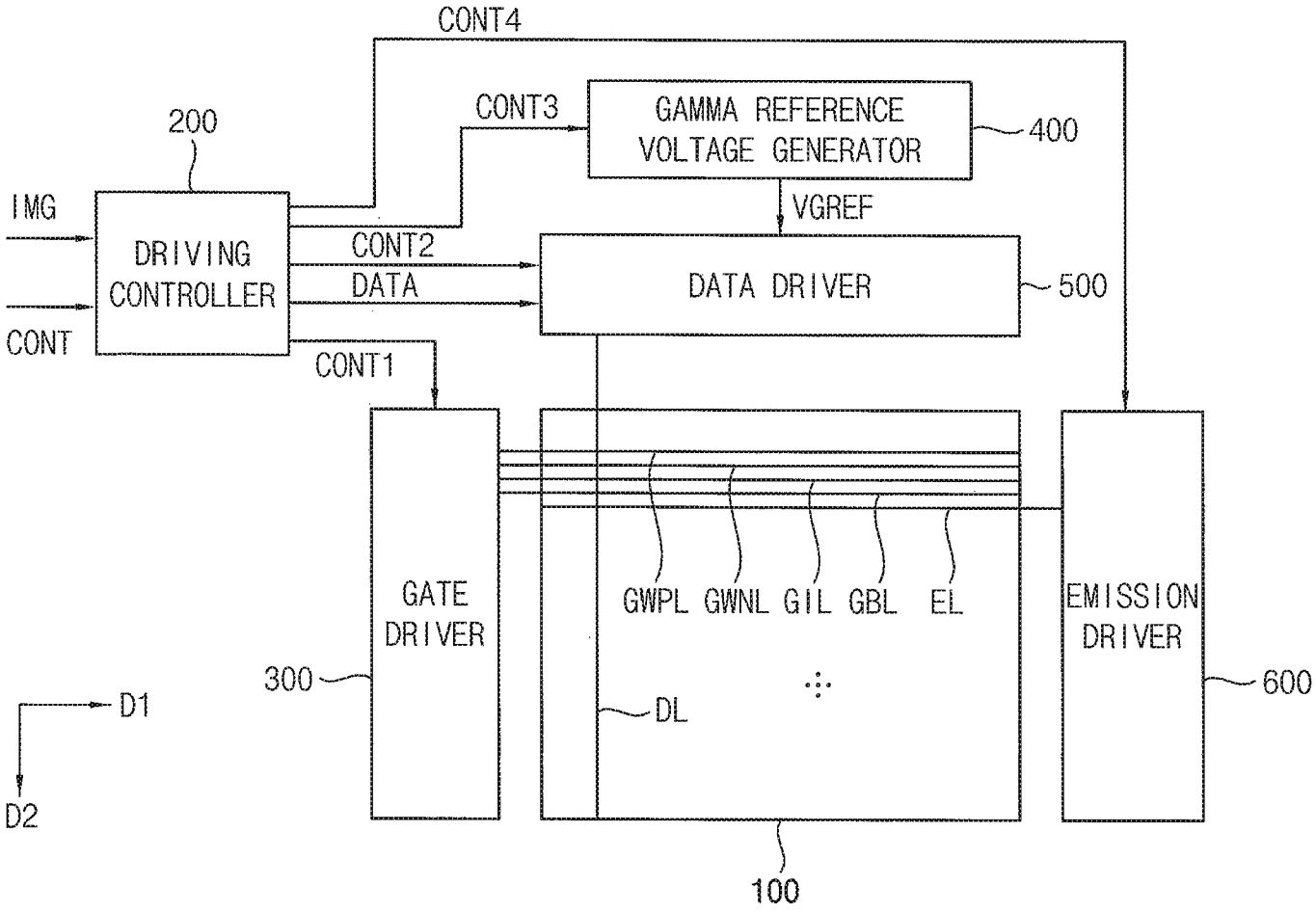
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400, a data driver 500 and an emission driver 600.

The display panel 100 has a display region on which an image is displayed and a peripheral region adjacent to the display region.

The display panel 100 includes a plurality of gate lines GWPL, GWNL, GIL and GBL, a plurality of data lines DL, a plurality of emission lines EL and a plurality of pixels electrically connected to the gate lines GWPL, GWNL, GIL and GBL, the data lines DL and the emission lines EL. The gate lines GWPL, GWNL, GIL and GBL may extend in a first direction D1, the data lines DL may extend in a second direction D2 crossing the first direction D1 and the emission lines EL may extend in the first direction D1.

The driving controller 200 receives input image data IMG and an input control signal CONT from an external apparatus (not shown). For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWPL, GWNL, GIL and GBL in response to the first control signal CONT1 received from the driving controller 200. The gate driver 300 may sequentially output the gate signals to the gate lines GWPL, GWNL, GIL and GBL.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

Figure 2:
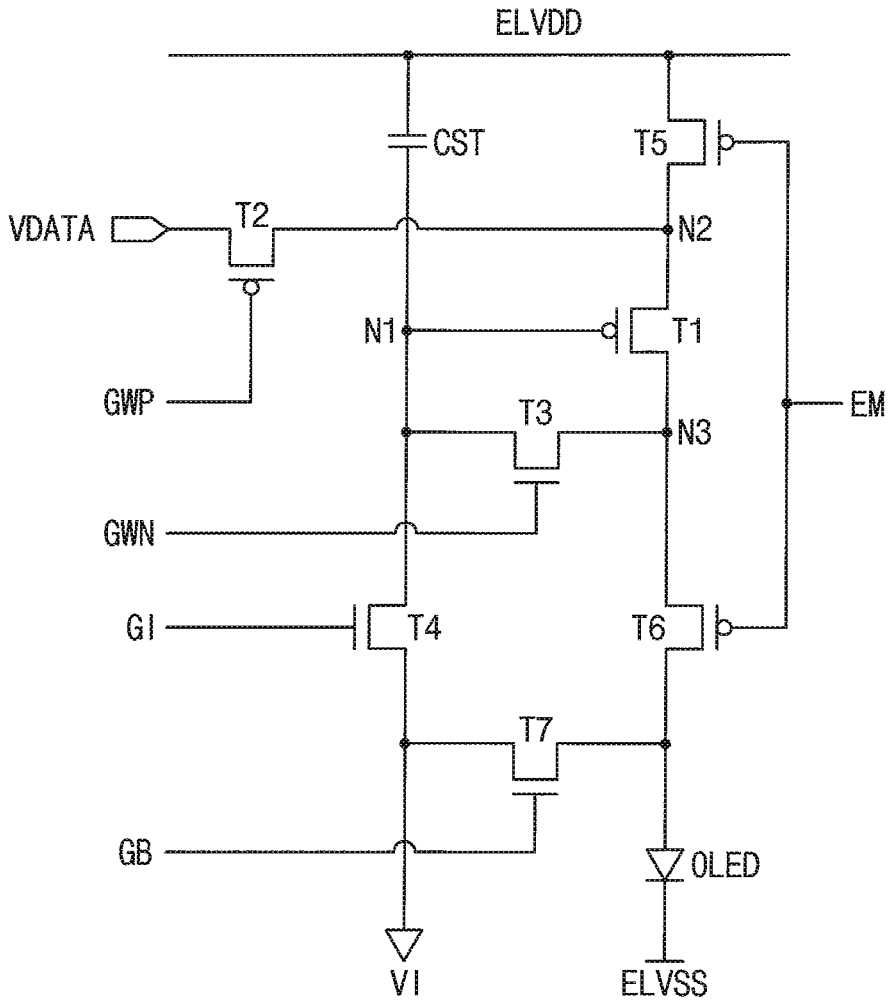
FIG. 2 is a circuit diagram illustrating a pixel of a display panel of FIG. 1.
Figure 3:
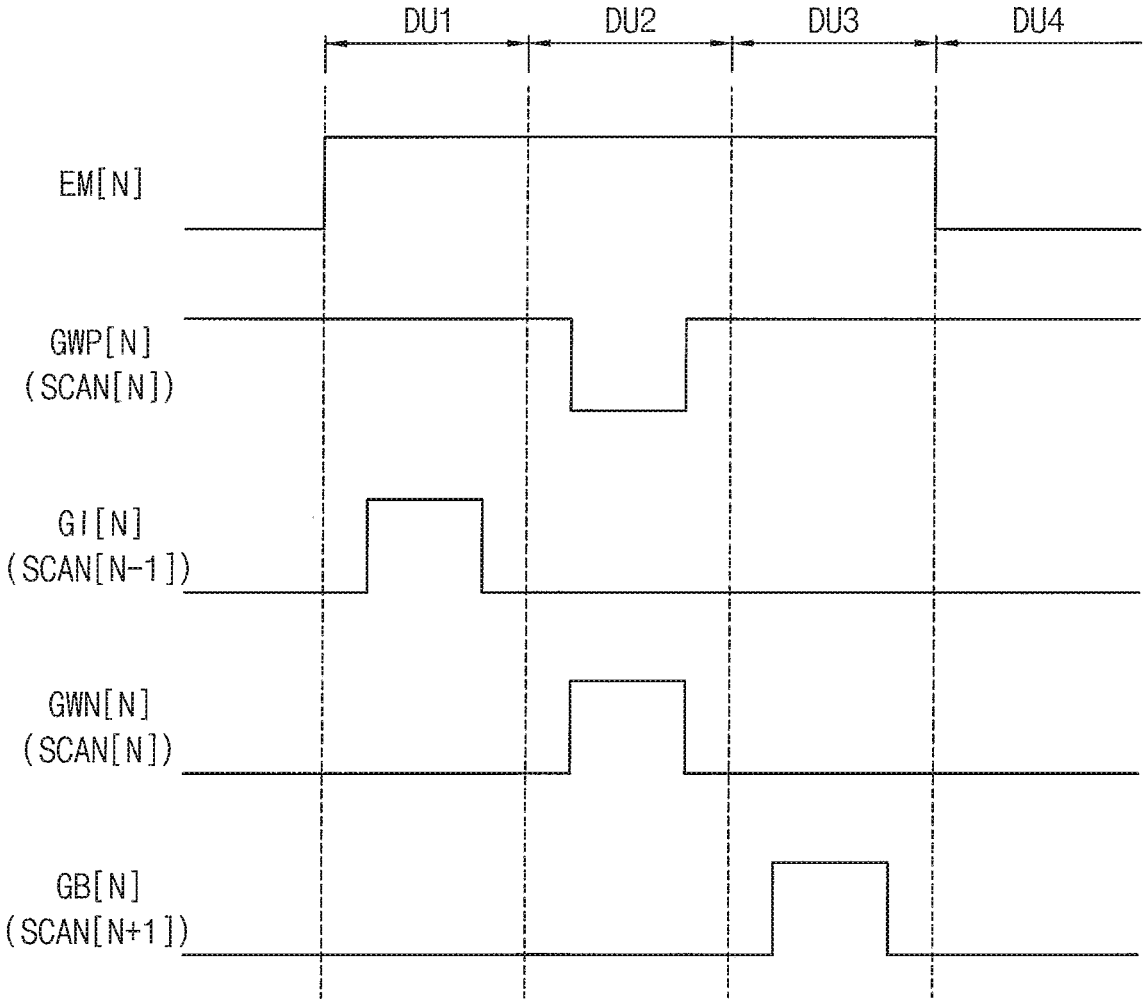
FIG. 3 is a timing diagram illustrating input signals applied to the pixel of FIG. 2.

FIG. 2 is a circuit diagram illustrating a pixel of the display panel 100 of FIG. 1. FIG. 3 is a timing diagram illustrating input signals applied to the pixel of FIG. 2.

Referring to FIGS. 1 to 3, the display panel 100 includes the plurality of the pixels. Each pixel includes an organic light emitting element OLED.

The pixel receives a data write gate signal GWP and GWN, a data initialization gate signal GI, an organic light emitting element initialization signal GB, the data voltage VDATA and the emission signal EM and the organic light emitting element OLED of the pixel emits light corresponding to the level of the data voltage VDATA to display the image.

In the present example embodiment, the pixel may include a switching element of a first type and a switching element of a second type different from the first type. For example, the switching element of the first type may be a polysilicon thin film transistor. For example, the switching element of the first type may be a low temperature polysilicon (LTPS) thin film transistor. For example, the switching element of the second type may be an oxide thin film transistor. For example, the switching element of the first type may be a P-type transistor and the switching element of the second type may be an N-type transistor.

For example, the data write gate signal may include a first data write gate signal GWP and a second data write gate signal GWN. The first data write gate signal GWP may be applied to the P-type transistor so that the first data write gate signal GWP has an activation signal of a low level corresponding to a data writing timing. The second data write gate signal GWN may be applied to the N-type transistor so that the second data write gate signal GWN has an activation signal of a high level corresponding to the data writing timing.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3.

For example, the first pixel switching element T1 may be the polysilicon thin film transistor. For example, the first pixel switching element T1 may be the P-type thin film transistor. The control electrode of the first pixel switching element T1 may be a gate electrode, the input electrode of the first pixel switching element T1 may be a source electrode and the output electrode of the first pixel switching element T1 may be a drain electrode.

The second pixel switching element T2 includes a control electrode to which the first data write gate signal GWP is applied, an input electrode to which the data voltage VDATA is applied and an output electrode connected to the second node N2.

For example, the second pixel switching element T2 may be the polysilicon thin film transistor. For example, the second pixel switching element T2 may be the P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3 includes a control electrode to which the second data write gate signal GWN is applied, an input electrode connected to the first node N1 and an output electrode connected to the third node N3.

For example, the third pixel switching element T3 may be the oxide thin film transistor. For example, the third pixel switching element T3 may be the N-type thin film transistor. The control electrode of the third pixel switching element T3 may be a gate electrode, the input electrode of the third pixel switching element T3 may be a source electrode and the output electrode of the third pixel switching element T3 may be a drain electrode.

The fourth pixel switching element T4 includes a control electrode to which the data initialization gate signal GI is applied, an input electrode to which an initialization voltage VI is applied and an output electrode connected to the first node N1.

For example, the fourth pixel switching element T4 may be the oxide thin film transistor. For example, the fourth pixel switching element T4 may be the N-type thin film transistor. The control electrode of the fourth pixel switching element T4 may be a gate electrode, the input electrode of the fourth pixel switching element T4 may be a source electrode and the output electrode of the fourth pixel switching element T4 may be a drain electrode.

The fifth pixel switching element T5 includes a control electrode to which the emission signal EM is applied, an input electrode to which a high power voltage ELVDD is applied and an output electrode connected to the second node N2.

For example, the fifth pixel switching element T5 may be the polysilicon thin film transistor. For example, the fifth pixel switching element T5 may be the P-type thin film transistor. The control electrode of the fifth pixel switching element T5 may be a gate electrode, the input electrode of the fifth pixel switching element T5 may be a source electrode and the output electrode of the fifth pixel switching element T5 may be a drain electrode.

The sixth pixel switching element T6 includes a control electrode to which the emission signal EM is applied, an input electrode connected to the third node N3 and an output electrode connected to an anode electrode of the organic light emitting element OLED.

For example, the sixth pixel switching element T6 may be the polysilicon thin film transistor. For example, the sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode to which the organic light emitting element initialization gate signal GB is applied, an input electrode to which the initialization voltage VI is applied and an output electrode connected to the anode electrode of the organic light emitting element OLED.

For example, the seventh pixel switching element T7 may be the oxide thin film transistor. For example, the seventh pixel switching element T7 may be the N-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode and a cathode electrode to which a low power voltage ELVSS is applied.

In FIG. 3, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the first and second data write gate signals GWP and GWN. During a third duration DU3, the anode electrode of the organic light emitting element OLED is initialized in response to the organic light emitting element initialization gate signal GB. During a fourth duration DU4, the organic light emitting element OLED emit the light in response to the emission signal EM so that the display panel 100 displays the image.

Although an emission off duration of the emission signal EM corresponds to first to third durations DU1, DU2 and DU3 in the present example embodiment, the present inventive concept is not limited thereto. The emission off duration of the emission signal EM may be set to include the data writing duration DU2. The emission off duration of the emission signal EM may be longer than a sum of the first to third durations DU1, DU2 and DU3.

During the first duration DU1, the data initialization gate signal GI may have an active level. For example, the active level of the data initialization gate signal GI may be a high level. When the data initialization gate signal GI has the active level, the fourth pixel switching element T4 is turned on so that the initialization voltage VI may be applied to the first node N1. The data initialization gate signal GI[N] of a present stage may be generated based on a scan signal SCAN[N−1] of a previous stage.

During the second duration DU2, the first data write gate signal GWP and the second data write gate signal GWN may have an active level. For example, the active level of the first data write gate signal GWP may be a low level and the active level of the second data write gate signal GWN may be a high level. When the first data write gate signal GWP and the second data writhe gate signal GWN have the active level, the second pixel switching element T2 and the third pixel switching element T3 are turned on. In addition, the first pixel switching element T1 is turned on in response to the initialization voltage VI. The first data write gate signal GWP[N] of the present stage may be generated based on a scan signal SCAN[N] of the present stage. The second data write gate signal GWN[N] of the present stage may be generated based on the scan signal SCAN[N] of the present stage.

A voltage which is subtraction an absolute value |VTH| of the threshold voltage of the first pixel switching element T1 from the data voltage VDATA may be charged in the storage capacitor CST along a path generated by the first to third pixel switching elements T1, T2 and T3.

During the third duration DU3, the organic light emitting element initialization signal GB may have an active level. For example, the active level of the organic light emitting element initialization signal GB may be a high level. When the organic light emitting element initialization signal GB has the active level, the seventh pixel switching element T7 is turned on so that the initialization voltage VI may be applied to the anode electrode of the organic light emitting element OLED. The organic light emitting element initialization signal GB[N] of the present stage may be generated based on a scan signal SCAN[N+1] of a next stage.

During the fourth duration DU4, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the voltage stored in the storage capacitor CST.

A driving current flows through the fifth pixel switching element T5, the first pixel switching element T1 and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined as following Equation 1.

$$ISD=\tfrac{1}{2}\mu Co\omega W/L(VSG-|VTH|)^2 \quad \text{[Equation 1]}$$

In Equation 1, μ is a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as following Equation 2.

$$VG=VDATA-|VTH| \quad \text{[Equation 2]}$$

When the organic light emitting element OLED emits the light during the fourth duration DU4, the driving voltage VOV and the driving current ISD may be represented as following Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{[Equation 3]}$$

$$ISD = \frac{1}{2}\mu Cox\frac{W}{L}(ELVDD - VDATA)^2 \quad \text{[Equation 4]}$$

The threshold voltage |VTH| is compensated during the second duration DU2, so that the driving current ISD may be determined regardless of the threshold voltage |VTH| of the first pixel switching element T1 when the organic light emitting element OLED emits the light during the fourth duration DU4.

In the present example embodiment, when the image displayed on the display panel 100 is a static image or the display panel is operated in always on mode, a driving frequency of the display panel 100 may be decreased to reduce a power consumption. When all of the switching elements of the pixel of the display panel 100 are polysilicon thin film transistor, a flicker may be generated due to a leakage current of the pixel switching element in the low frequency driving mode. Thus, some of the pixel switching elements may be designed using the oxide thin film transistors. In the present example embodiment, the third pixel switching element T3, the fourth pixel switching element T4 and the seventh pixel switching element T7 may be the oxide thin film transistors. The first pixel switching element T1, the second pixel switching element T2, the fifth pixel switching element T5 and the sixth pixel switching element T6 may be the polysilicon thin film transistors.

Figure 4A:
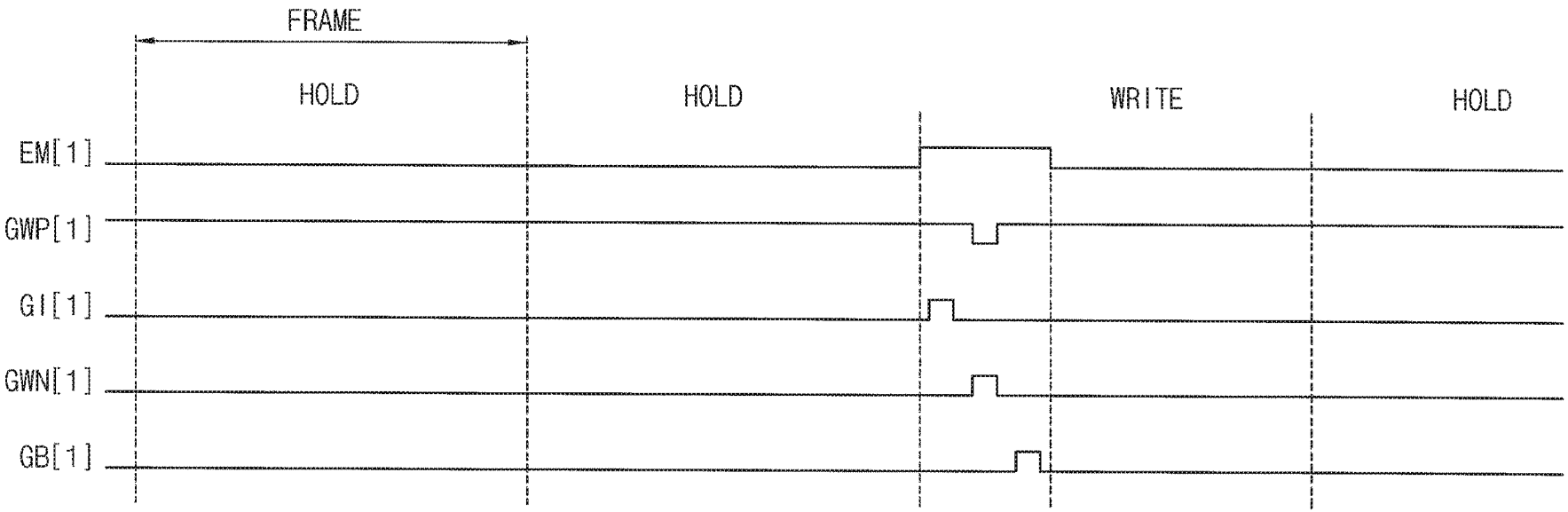
FIG. 4*a* is a timing diagram illustrating signals applied to the pixels of the display panel of FIG. 2 in a low frequency driving mode.
Figure 4B:
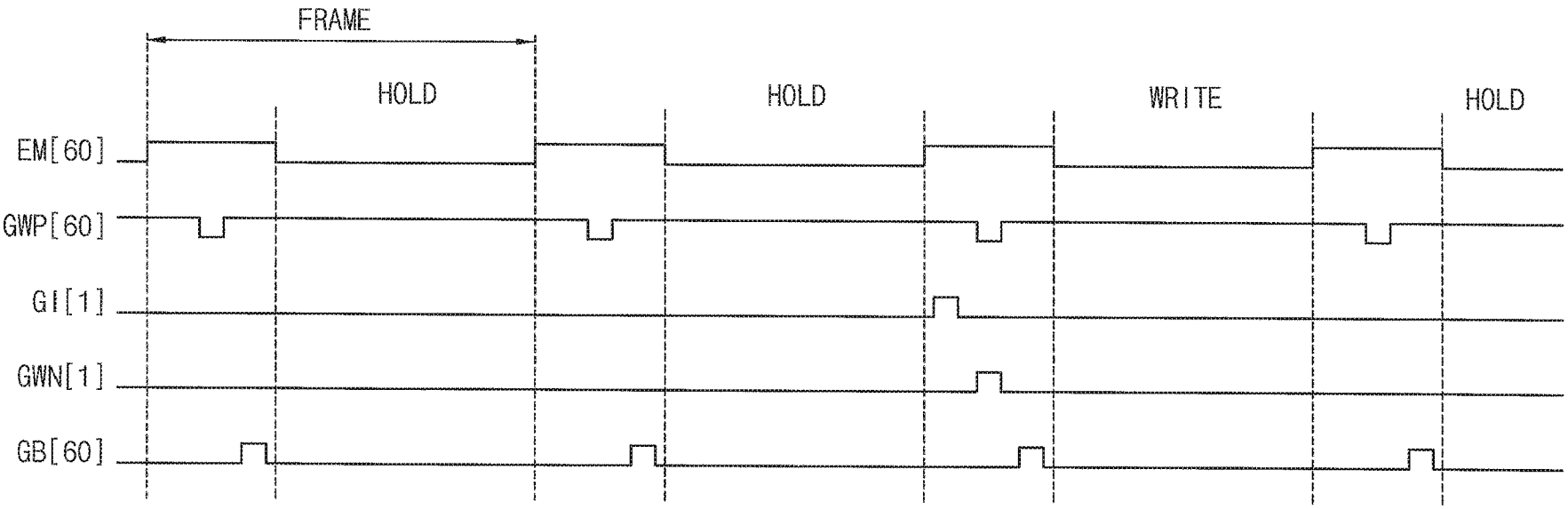
FIG. 4*b* is a timing diagram illustrating signals applied to the pixels of the display panel of FIG. 2 in a low frequency hybrid driving mode.

FIG. 4*a* is a timing diagram illustrating signals applied to the pixels of the display panel of FIG. 2 in a low frequency driving mode. FIG. 4*b* is a timing diagram illustrating signals applied to the pixels of the display panel of FIG. 2 in a low frequency hybrid driving mode.

Referring to FIGS. 1 to 4*b*, the display panel 100 may be driven in a first mode and a second mode. In the first mode, the display panel driver may drive at least one of the switching elements (e.g. T2, T5 and T6) of the first type and at least one of the switching elements (e.g. T3 and T4) of the second type in a high driving frequency. In the second mode, the display panel driver may drive at least one of the switching elements (e.g. T2, T5 and T6) of the first type in the high driving frequency and drive at least one of the switching elements (e.g. T3 and T4) of the second type in a low driving frequency less than the high driving frequency.

The first mode may be a high frequency driving mode. The second mode may be a low frequency hybrid driving mode.

However, all of the switching elements of the second type may not be driven in the low driving frequency in the second mode. The switching element (e.g. T7) of the second type may be an element for initializing the organic light emitting element so that the seventh pixel switching element T7 may be driven in the high driving frequency like the fifth pixel switching element T5 and the sixth pixel switching element T6 in the second mode.

Alternatively, in a third mode, the display panel driver may drive at least one of the switching elements of the first type and at least one of the switching elements of the second type in the low driving frequency.

The first mode may be a high frequency driving mode. The third mode may be a low frequency driving mode.

The display panel driver (e.g. the driving controller 200) may analyze the input image. The display panel driver may determine whether the input image is a movie image or a static image.

When the input image is the movie image, the display panel 100 may be driven in the high frequency driving mode. When the input image is the static image, the display panel 100 may be driven in the low frequency hybrid driving mode or in the low frequency driving mode.

FIG. 4*a* represents the signal of the low frequency driving mode. In the low frequency driving mode, the emission signal EM, the first data write gate signal GWP, the data initialization gate signal GI, the second data write gate signal GWN and the organic light emitting element initialization gate signal GB may be driven in the low driving frequency.

In FIG. 4*a*, the high driving frequency may be 60 Hz and the low driving frequency may be 1 Hz. Herein, in the low frequency driving mode, a writing operation WRITE is performed in one frame and holding operations HOLD are performed in fifty nine frames in a second.

FIG. 4*b* represents the signal of the low frequency hybrid driving mode. In the low frequency hybrid driving mode, the emission signal EM, the first data write gate signal GWP and the organic light emitting element initialization gate signal GB may be driven in the high driving frequency and the data initialization gate signal GI and the second data write gate signal GWN may be driven in the low driving frequency.

In FIG. 4*b*, the high driving frequency may be 60 Hz and the low driving frequency may be 1 Hz. Herein, in the low frequency hybrid driving mode, a writing operation WRITE is performed in one frame and holding operations HOLD are operated in fifty nine frames in a second. In the holding operation HOLD, the organic light emitting element may be repetitively turned on and off.

In terms of power saving, the low frequency driving mode may be better than the low frequency hybrid driving mode, but the flicker may be visually perceived to a user in the low frequency driving mode according to the input image. Thus, the display panel 100 may be selectively driven in the low frequency driving mode and the low frequency hybrid driving mode.

Figure 6A:
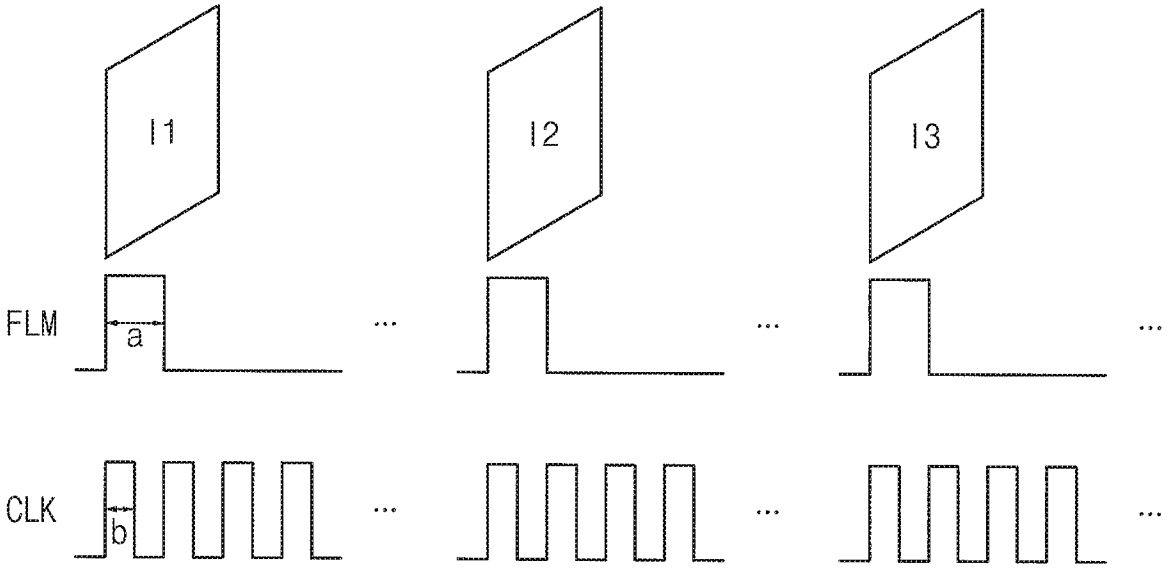
FIG. 6*a* is a timing diagram illustrating the vertical start signal and the gate clock signal applied to the gate driver of FIG. 1 in a high frequency driving mode.
Figure 6B:
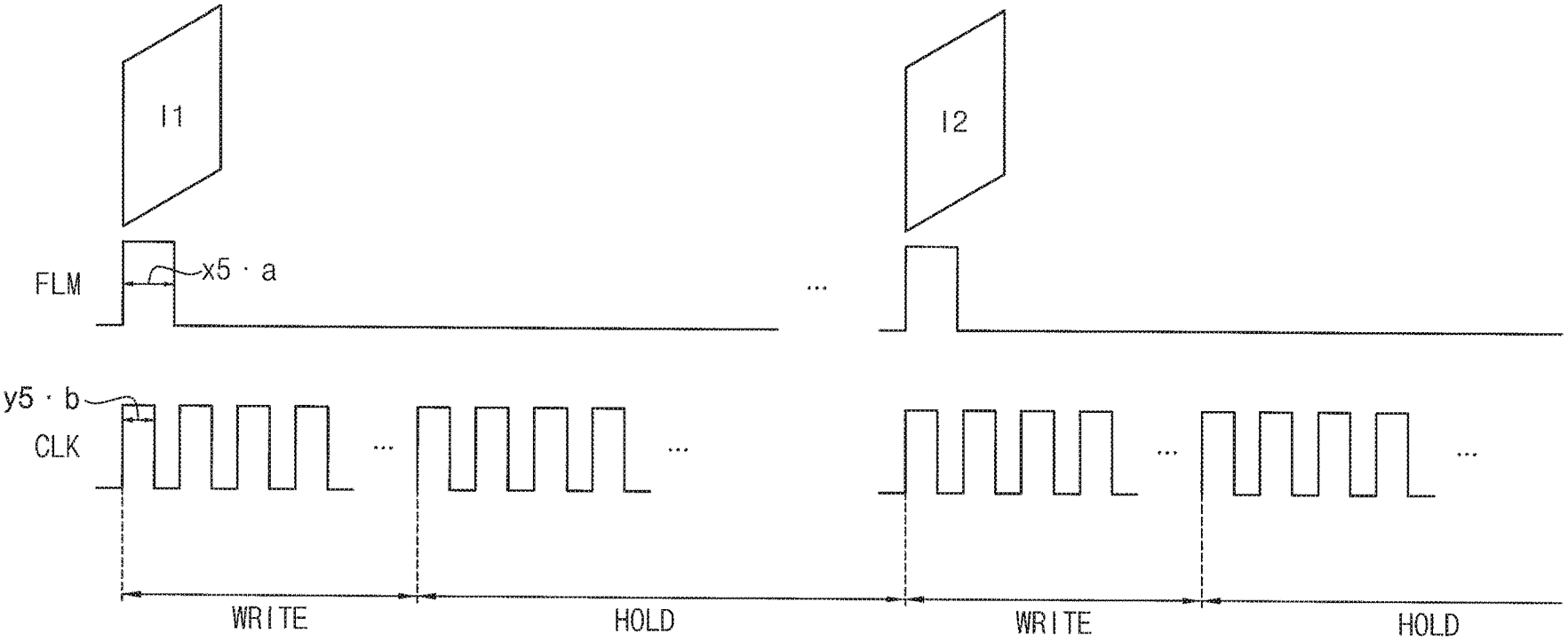
FIG. 6*b* is a timing diagram illustrating the vertical start signal and the gate clock signal applied to the gate driver of FIG. 1 in the low frequency driving mode.
Figure 7A:
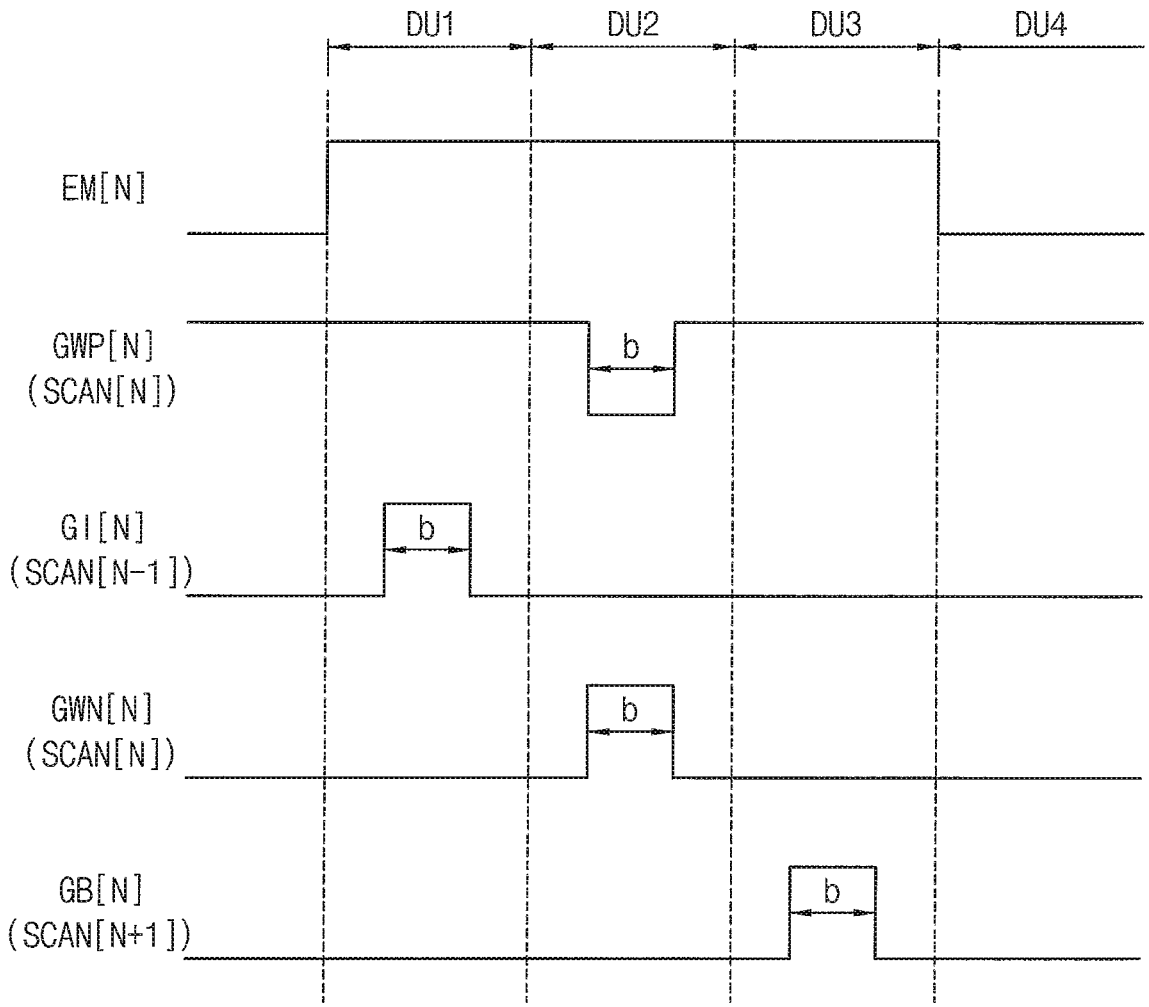
FIG. 7*a* is a timing diagram illustrating input signals applied to the pixel of the display panel of FIG. 2 in the high frequency driving mode.
Figure 7B:
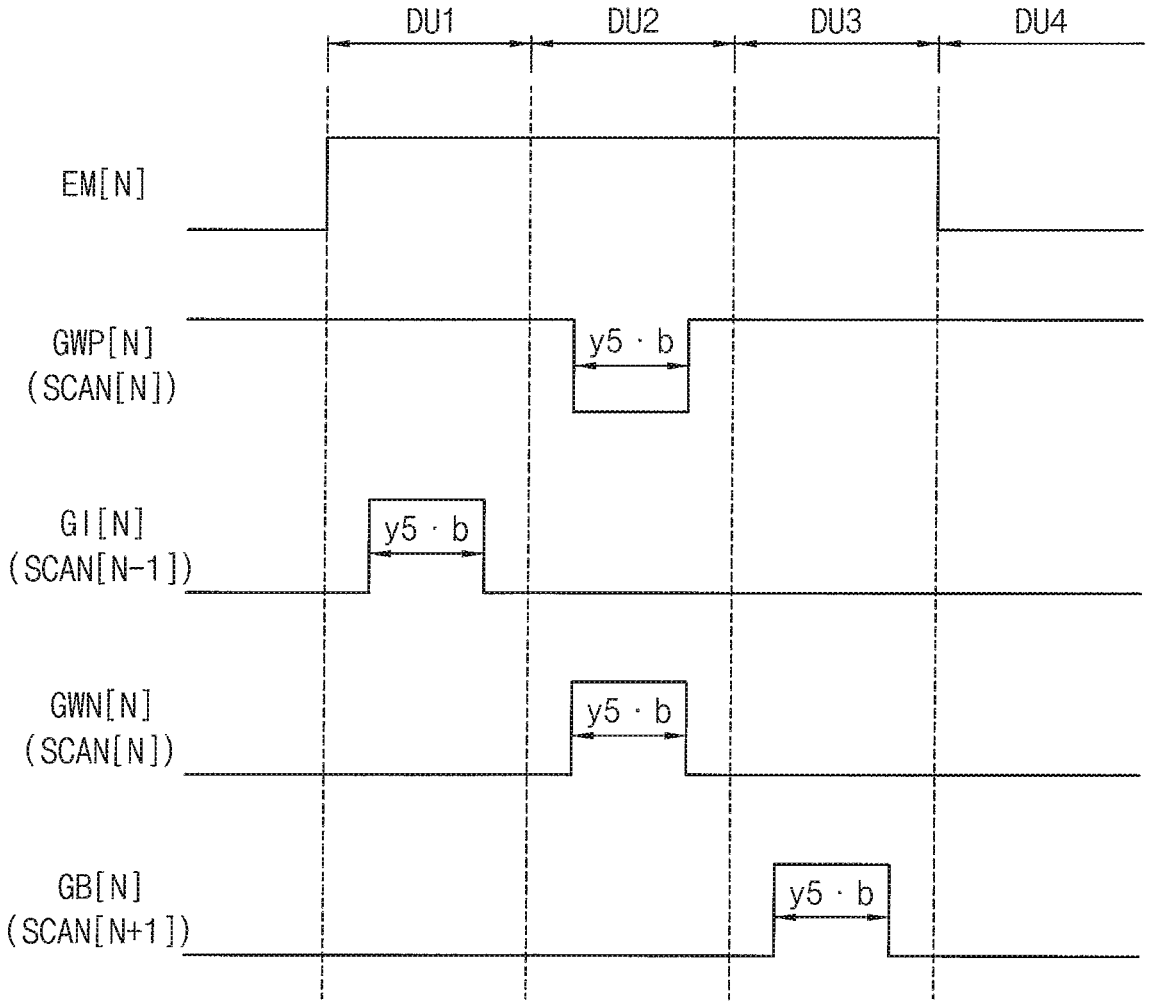
FIG. 7*b* is a timing diagram illustrating input signals applied to the pixel of the display panel of FIG. 2 in the low frequency driving mode.

FIG. 5 is a table illustrating an active duration of a vertical start signal and an active duration of a gate clock signal applied to a gate driver of FIG. 1 according to a driving frequency of the display panel of FIG. 1. FIG. 6*a* is a timing diagram illustrating the vertical start signal and the gate clock signal applied to the gate driver of FIG. 1 in a high frequency driving mode. FIG. 6*b* is a timing diagram illustrating the vertical start signal and the gate clock signal applied to the gate driver of FIG. 1 in the low frequency driving mode. FIG. 7*a* is a timing diagram illustrating input signals applied to the pixel of the display panel of FIG. 2 in the high frequency driving mode. FIG. 7*b* is a timing diagram illustrating input signals applied to the pixel of the display panel of FIG. 2 in the low frequency driving mode.

Referring to FIGS. 1 to 7*b*, the driving frequency of the display panel 100 may be varied according to the input image. For example, the driving frequency of the display panel 100 may be determined as one of 60 Hz, 30 Hz, 20 Hz, 10 Hz, 2 Hz and 1 Hz according to the input image.

The gate driver 300 may generate the gate signal based on the vertical start signal FLM and the gate clock signal CLK and output the gate signal to the display panel 100. For example, the gate signal may include the data write gate signal GWP and GWN, the data initialization gate signal GI and the organic light emitting element initialization gate signal GB.

In the present example embodiment, the gate clock signal CLK may have an active duration varied according to the driving frequency. As the driving frequency decreases, a length of the active duration of the gate clock signal CLK may become longer.

When the display panel 100 is driven in the high driving frequency, the turn-on time of the third pixel switching element T3 of FIG. 2 may not be sufficient and the current leakage may be occurred through the turned-off fourth pixel switching element T4 of FIG. 2 so that the luminance of the image represented by the pixel may be reduced.

When the active duration of the gate clock signal CLK increases, the active duration of the data write gate signals GWP and GWN, the active duration of the data initialization gate signal GI and the active duration of the organic light emitting element initialization signal GB may increase.

When the active duration of the gate clock signal CLK increases, an active duration of the data write gate signal GWN applied to the third pixel switching element T3 may increase. Accordingly, the turn-on time of the third pixel switching element T3 may be sufficient in the low frequency driving mode (or in the low frequency hybrid driving mode) so that the decrease of the luminance of the image represented by the pixel may be prevented.

In addition, when the active duration of the gate clock signal CLK increases, an active duration of the data write gate signal GWP applied to the second pixel switching element T2 may increase. Accordingly, the turn-on time of the second pixel switching element T2 may be sufficient in the low frequency driving mode (or in the low frequency hybrid driving mode) so that the decrease of the luminance of the image represented by the pixel may be prevented.

In FIG. 5, y1 may be equal to or greater than 1, y2 may be equal to or greater than y1, y3 may be equal to or greater than y2, y4 may be equal to or greater than y3 and y5 may be equal to or greater than y4.

In the present example embodiment, the vertical start signal FLM may have an active duration varied according to the driving frequency. As the driving frequency decreases, a length of the active duration of the vertical start signal FLM may increase.

When the active duration of the gate clock signal CLK increases, the active duration of the vertical start signal FLM may be set to be increased to normally operate the gate driver 300. A single active duration of the vertical start signal FLM may be greater than a single active duration of the gate clock signal CLK.

In FIG. 5, x1 may be equal to or greater than 1, x2 may be equal to or greater than x1, x3 may be equal to or greater than x2, x4 may be equal to or greater than x3 and x5 may be equal to or greater than x4.

According to the present example embodiment, the gate clock signal CLK having the activation duration of the varied length according to the driving frequency may be applied to the gate driver 300. Accordingly, the luminance difference between the images of the display panel 100 according to the driving frequency may be compensated so that the display quality of the display panel 100 may be enhanced.

Therefore, the display quality deterioration in the low frequency driving mode (or in the low frequency hybrid driving mode) may be resolved so that the power consumption of the display apparatus may be reduced and the display quality of the display panel 100 may be enhanced.

Figure 8:
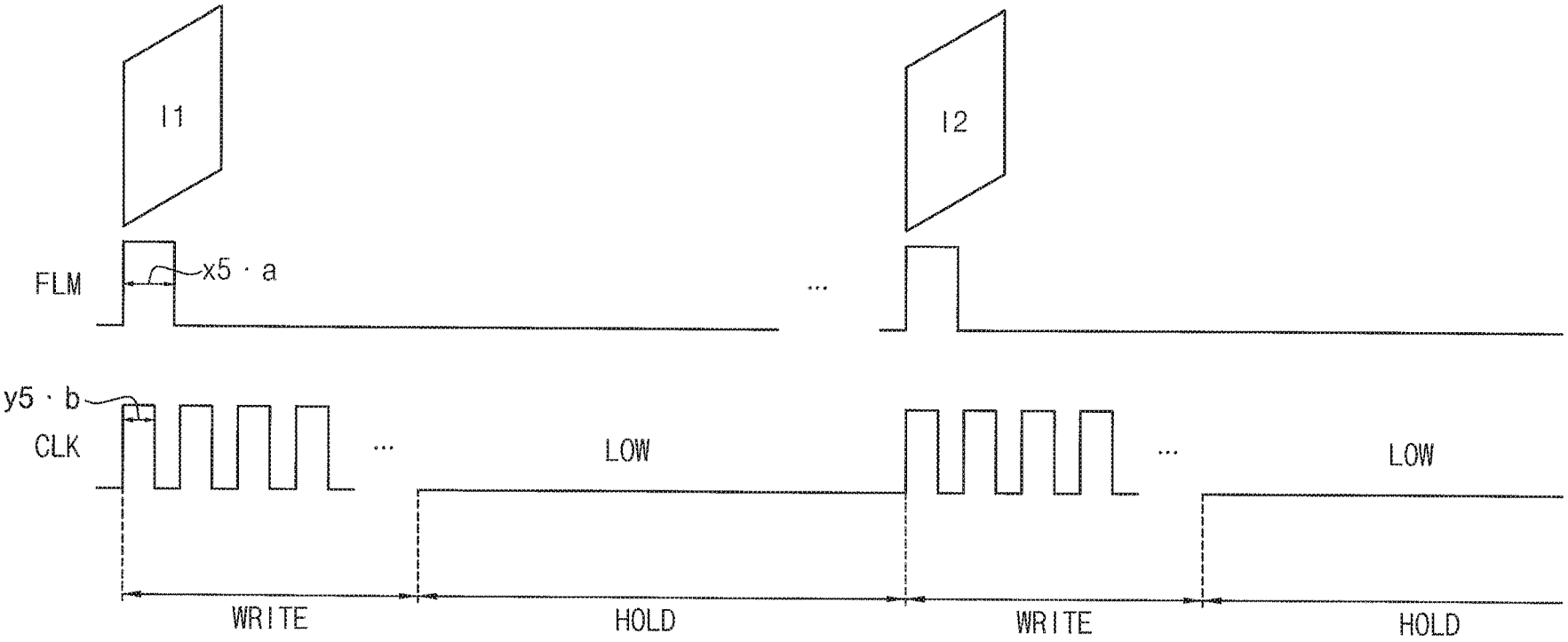
FIG. 8 is a timing diagram illustrating a vertical start signal and a gate clock signal applied to a gate driver in a low frequency driving mode of a display panel according to an example embodiment of the present inventive concept.

FIG. 8 is a timing diagram illustrating a vertical start signal and a gate clock signal applied to a gate driver in a low frequency driving mode of a display panel according to an example embodiment of the present inventive concept.

The display apparatus according to the present example embodiment is substantially the same as the display apparatus of the previous example embodiment explained referring to FIGS. 1 to 7*b* except for the gate clock signal. Thus, the same reference numerals will be used to refer to the same or like parts as those described in the previous example embodiment of FIGS. 1 to 7*b* and any repetitive explanation concerning the above elements will be omitted.

Referring to FIGS. 1 to 5 and 7*a* to 8, the driving frequency of the display panel 100 may be varied according to the input image. For example, the driving frequency of the display panel 100 may be determined as one of 60 Hz, 30 Hz, 20 Hz, 10 Hz, 2 Hz and 1 Hz according to the input image.

The gate driver 300 may generate the gate signal based on the vertical start signal FLM and the gate clock signal CLK and output the gate signal to the display panel 100. For example, the gate signal may include the data write gate signal GWP and GWN, the data initialization gate signal GI and the organic light emitting element initialization gate signal GB.

In the present example embodiment, the gate clock signal CLK may have an active duration varied according to the driving frequency. As the driving frequency decreases, a length of the active duration of the gate clock signal CLK may increases.

In the low frequency driving mode, the gate clock signal CLK may swing between a high level and a low level in a writing frame when the data is written to the pixel. In the low frequency driving mode, the gate clock signal CLK may maintain the low level in a holding frame when the data written to the pixel is maintained.

According to the present example embodiment, the gate clock signal CLK having the activation duration of the varied length according to the driving frequency may be applied to the gate driver 300. Accordingly, the luminance difference between the images of the display panel 100 according to the driving frequency may be compensated so that the display quality of the display panel 100 may be enhanced.

In the holding frame of the low frequency driving mode (or the low frequency hybrid driving mode), the gate clock signal may not swing but maintain the low level in the holding frame so that the power consumption of the display apparatus may be further reduced.

Therefore, the display quality deterioration generated in the low frequency driving mode may be resolved so that the power consumption of the display apparatus may be reduced and the display quality of the display panel 100 may be enhanced.

Figure 9:
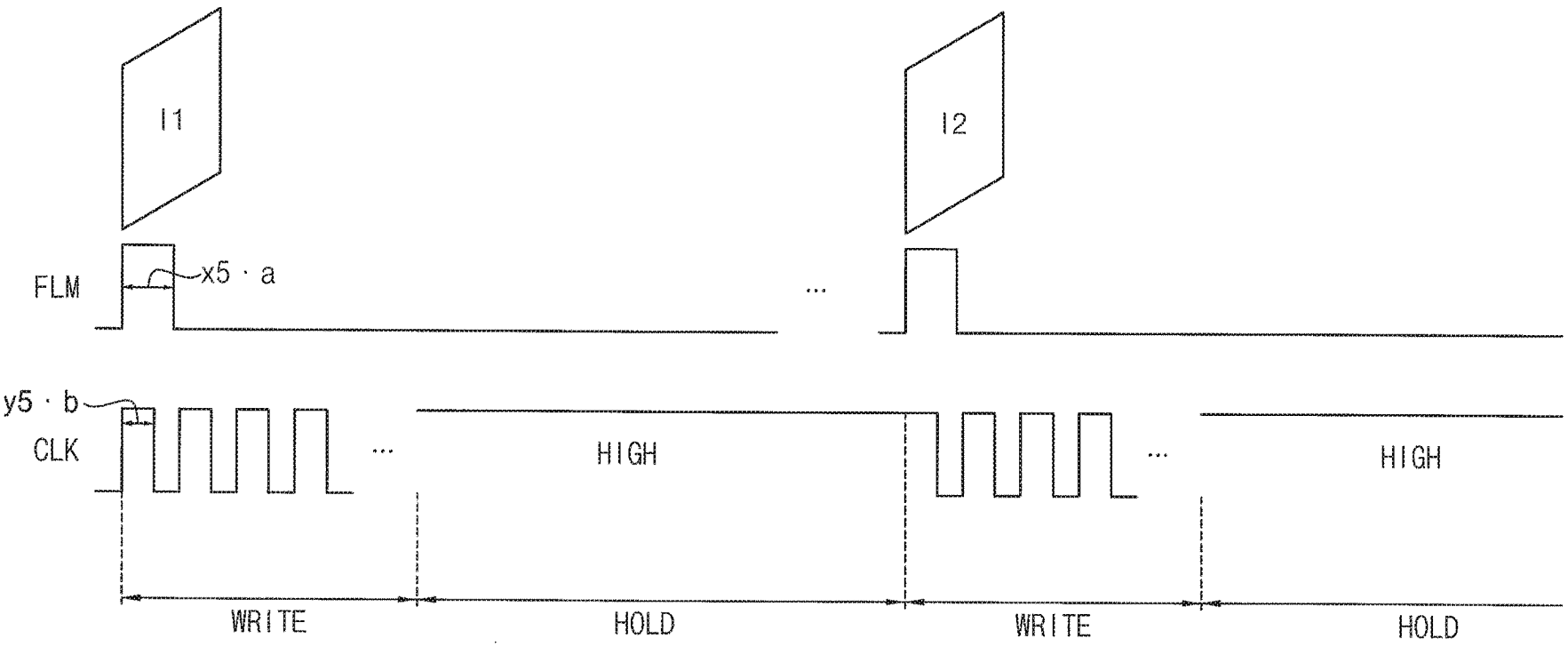
FIG. 9 is a timing diagram illustrating a vertical start signal and a gate clock signal applied to a gate driver in a low frequency driving mode of a display panel according to an example embodiment of the present inventive concept.

FIG. 9 is a timing diagram illustrating a vertical start signal and a gate clock signal applied to a gate driver in a low frequency driving mode of a display panel according to an example embodiment of the present inventive concept.

The display apparatus according to the present example embodiment is substantially the same as the display apparatus of the previous example embodiment explained referring to FIGS. 1 to 7*b* except for the gate clock signal. Thus, the same reference numerals will be used to refer to the same or like parts as those described in the previous example embodiment of FIGS. 1 to 7*b* and any repetitive explanation concerning the above elements will be omitted.

Referring to FIGS. 1 to 5, 7*a*, 7*b* and 9, the driving frequency of the display panel 100 may be varied according to the input image. For example, the driving frequency of the display panel 100 may be determined as one of 60 Hz, 30 Hz, 20 Hz, 10 Hz, 2 Hz and 1 Hz according to the input image.

The gate driver 300 may generate the gate signal based on the vertical start signal FLM and the gate clock signal CLK and output the gate signal to the display panel 100. For example, the gate signal may include the data write gate signal GWP and GWN, the data initialization gate signal GI and the organic light emitting element initialization gate signal GB.

In the present example embodiment, the gate clock signal CLK may have an active duration varied according to the driving frequency. As the driving frequency decreases, a length of the active duration of the gate clock signal CLK may increases.

In the low frequency driving mode, the gate clock signal CLK may swing between a high level and a low level in a writing frame when the data is written to the pixel. In the low frequency driving mode, the gate clock signal CLK may maintain the high level in a holding frame when the data written to the pixel is maintained.

According to the present example embodiment, the gate clock signal CLK having the activation duration of the varied length according to the driving frequency may be applied to the gate driver 300. Accordingly, the luminance difference between the images of the display panel 100 according to the driving frequency may be compensated so that the display quality of the display panel 100 may be enhanced.

In the holding frame of the low frequency driving mode (or the low frequency hybrid driving mode), the gate clock signal may not swing but maintain the high level in the holding frame so that the power consumption of the display apparatus may be further reduced.

Therefore, the display quality deterioration generated in the low frequency driving mode may be resolved so that the power consumption of the display apparatus may be reduced and the display quality of the display panel 100 may be enhanced.

Figure 11:
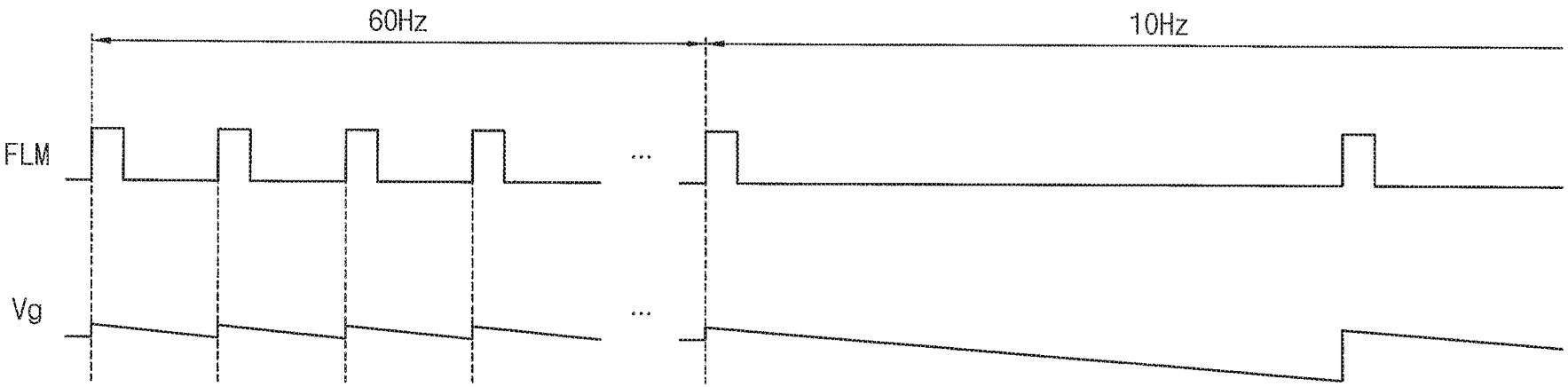
FIG. 11 is a timing diagram illustrating a gate voltage of a first pixel switching element of the display panel of FIG. 10 when the high power voltage is not compensated according to the driving frequency.
Figure 12:
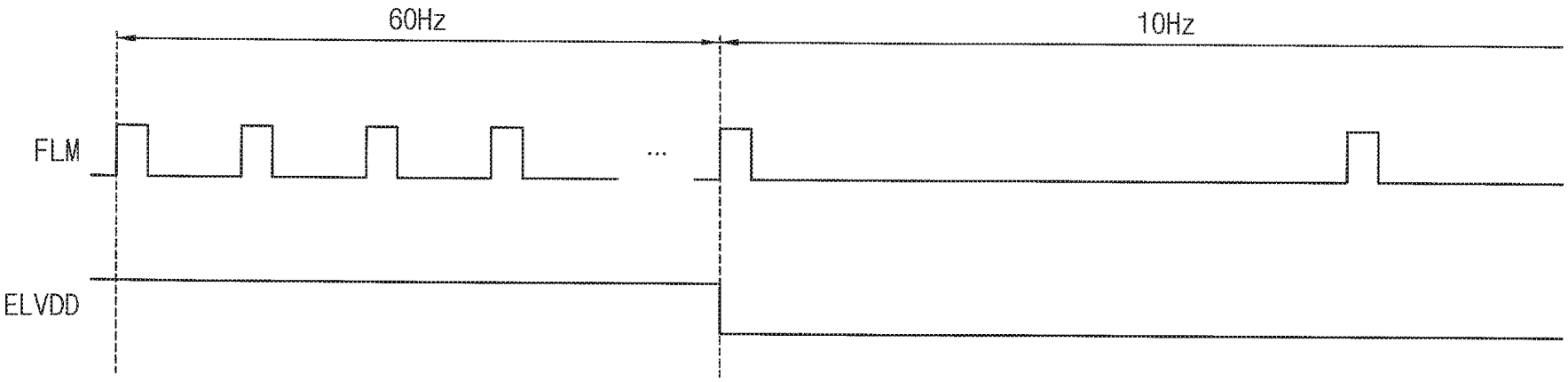
FIG. 12 is a timing diagram illustrating an example of the high power voltage of the display panel of FIG. 10 when the high power voltage is compensated according to the driving frequency.
Figure 13:
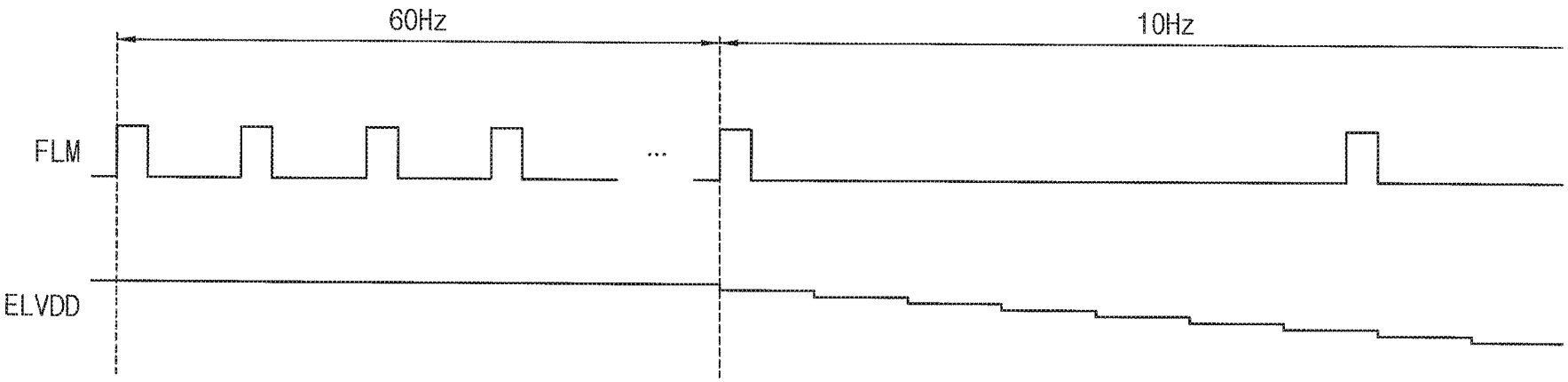
FIG. 13 is a timing diagram illustrating an example of the high power voltage of the display panel of FIG. 10 when the high power voltage is compensated according to the driving frequency.

FIG. 10 is a table illustrating a level of a high power voltage applied to a pixel according to a driving frequency of a display panel 100 according to an example embodiment of the present inventive concept. FIG. 11 is a timing diagram illustrating a gate voltage of a first pixel switching element T1 of the display panel 100 of FIG. 10 when the high power voltage ELVDD is not compensated according to the driving frequency. FIG. 12 is a timing diagram illustrating an example of the high power voltage ELVDD of the display panel 100 of FIG. 10 when the high power voltage ELVDD is compensated according to the driving frequency. FIG. 13 is a timing diagram illustrating an example of the high power voltage ELVDD of the display panel 100 of FIG. 10 when the high power voltage ELVDD is compensated according to the driving frequency.

The display apparatus according to the present example embodiment is substantially the same as the display apparatus of the previous example embodiment explained referring to FIGS. 1 to 7*b* except that the level of the high power voltage applied to the pixel is adjusted to enhance the display quality. Thus, the same reference numerals will be used to refer to the same or like parts as those described in the previous example embodiment of FIGS. 1 to 7*b* and any repetitive explanation concerning the above elements will be omitted.

Referring to FIGS. 1 to 4*b* and 10 to 13, the driving frequency of the display panel 100 may be varied according to the input image. For example, the driving frequency of the display panel 100 may be determined as one of 60 Hz, 30 Hz, 20 Hz, 10 Hz, 2 Hz and 1 Hz according to the input image.

In the present example embodiment, the high power voltage ELVDD applied to the pixel of the display panel 100 may be varied according to the driving frequency. As the driving frequency decreases, the level of the high power voltage ELVDD may decrease. In FIG. 10, for example, the high power voltage ELVDD is 4.6V for the driving frequency of 60 Hz, the high power voltage ELVDD is 4.4V for the driving frequency of 30 Hz, the high power voltage ELVDD is 4.3V for the driving frequency of 20 Hz, the high power voltage ELVDD is 4.2V for the driving frequency of 10 Hz, the high power voltage ELVDD is 4.1V for the driving frequency of 2 Hz and the high power voltage ELVDD is 4.0V for the driving frequency of 1 Hz. However, the present inventive concept may not be limited to the specific value of the driving frequency and the specific level of the high power voltage ELVDD.

As shown in FIG. 11, the level of the gate voltage Vg of the first pixel switching element T1 of the display panel 100 may be gradually reduced due to the leakage current as time passes. When the level of the gate voltage Vg of the first pixel switching element T1 is reduced, a voltage across the gate and source electrodes $V_{gs}$ of the first pixel switching element T1 may increase. When the voltage across the gate and source electrodes $V_{gs}$ of the first pixel switching element T1 increases, a drain current Id of the first pixel switching element T1 may increase. When the drain current Id of the first pixel switching element T1 increases, the luminance of the pixel may unintentionally increase.

When the display panel 100 is driven in the high frequency driving mode, the gate voltage Vg of the first pixel switching element T1 may be refreshed in a high frequency. However, when the display panel 100 is driven in the low frequency driving mode (or the low frequency hybrid driving mode), the gate voltage Vg of the first pixel switching element T1 may be refreshed in a low frequency so that the luminance difference of the pixel between the high frequency driving mode and the low frequency driving mode (or the low frequency hybrid driving mode) may be generated.

In the low frequency driving mode of the display panel 100, when the high power voltage ELVDD is decreased, the voltage across the gate and source electrodes $V_{gs}$ may not increase although the gate voltage Vg is reduced. Thus, when the high power voltage ELVDD is properly adjusted, the luminance difference of the pixel according to the change of the driving frequency may be prevented.

In FIG. 12, for example, the level of the high power voltage ELVDD may be decreased to a target level when the driving frequency is changed from a high frequency (60 Hz) to a lower frequency (10 Hz). In FIG. 13, for example, the level of the high power voltage ELVDD may be gradually decreased to the target level as time passes when the driving frequency is changed from a high frequency (60 Hz) to a lower frequency (10 Hz). When the level of the high power voltage ELVDD is gradually decreased to the target level, the decrease curve of the level of the high power voltage ELVDD may be further approached to the decrease curve of the level of the gate voltage Vg of the first pixel switching element T1 of FIG. 11 so that the luminance difference of the pixel according to the change of the driving frequency may be further effectively prevented.

According to the present example embodiment, the high power voltage ELVDD having the varied level according to the driving frequency may be applied to the pixel. Accordingly, the luminance difference between the images of the display panel 100 according to the driving frequency may be compensated so that the display quality of the display panel 100 may be enhanced.

Therefore, the display quality deterioration generated in the low frequency driving mode (or in the low frequency hybrid driving mode) may be resolved so that the power consumption of the display apparatus may be reduced and the display quality of the display panel 100 may be enhanced.

Figure 15:
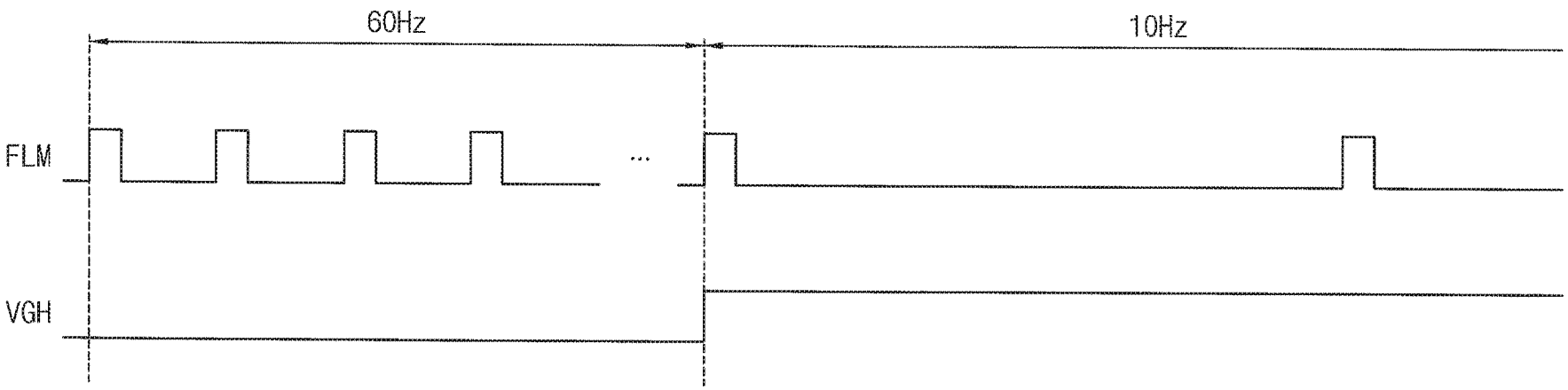
FIG. 15 is a timing diagram illustrating the gate on voltage of the gate driver of FIG. 14 when the gate on voltage is compensated according to the driving frequency.

FIG. 14 is a table illustrating a gate on voltage applied to a gate driver 300 according to a driving frequency of a display panel 100 according to an example embodiment of the present inventive concept. FIG. 15 is a timing diagram illustrating the gate on voltage VGH of the gate driver 300 of FIG. 14 when the gate on voltage is compensated according to the driving frequency.

The display apparatus according to the present example embodiment is substantially the same as the display apparatus of the previous example embodiment explained referring to FIGS. 1 to 7*b* except that the level of the high power voltage applied to the pixel is adjusted to enhance the display quality. Thus, the same reference numerals will be used to refer to the same or like parts as those described in the previous example embodiment of FIGS. 1 to 7*b* and any repetitive explanation concerning the above elements will be omitted.

Referring to FIGS. 1 to 4*b* and 14 and 15, the driving frequency of the display panel 100 may be varied according to the input image. For example, the driving frequency of the display panel 100 may be determined as one of 60 Hz, 30 Hz, 20 Hz, 10 Hz, 2 Hz and 1 Hz according to the input image.

In the present example embodiment, the gate on voltage VGH applied to the gate driver 300 may be varied according to the driving frequency. As the driving frequency decreases, the level of the gate on voltage VGH may increases. In FIG. 14, for example, the gate on voltage VGH is 7.0V for the driving frequency of 60 Hz, the gate on voltage VGH is 7.1V for the driving frequency of 30 Hz, the gate on voltage VGH is 7.2V for the driving frequency of 20 Hz, the gate on voltage VGH is 7.3V for the driving frequency of 10 Hz, the gate on voltage VGH is 7.4V for the driving frequency of 2 Hz and the gate on voltage VGH is 7.5V for the driving frequency of 1 Hz. However, the present inventive concept may not be limited to the specific value of the driving frequency and the specific level of the gate on voltage VGH.

When the display panel 100 is driven in the high driving frequency, the turn-on time of the third pixel switching element T3 of FIG. 2 may not be sufficient and the current leakage may be occurred through the turned-off fourth pixel switching element T4 of FIG. 2 so that the luminance of the image represented by the pixel may be reduced.

When the level of the gate on voltage VGH increases, the high level of the data write gate signals GWP and GWN, the high level of the data initialization gate signal GI and the high level of the organic light emitting element initialization signal GB may increase.

When the level of the gate on voltage VGH increases, the high level of the data write gate signal GWN applied to the third pixel switching element T3 may increase. Accordingly, a driving force of the third pixel switching element T3 may increase in the low frequency driving mode (or in the low frequency hybrid driving mode) so that the decrease of the luminance of the image represented by the pixel may be prevented.

According to the present example embodiment, the gate on voltage VGH having the varied level according to the driving frequency may be applied to the gate driver 300. Accordingly, the luminance difference between the images of the display panel 100 according to the driving frequency may be compensated so that the display quality of the display panel 100 may be enhanced.

Therefore, the display quality deterioration generated in the low frequency driving mode (or in the low frequency hybrid driving mode) may be resolved so that the power consumption of the display apparatus may be reduced and the display quality of the display panel 100 may be enhanced.

Figure 16:
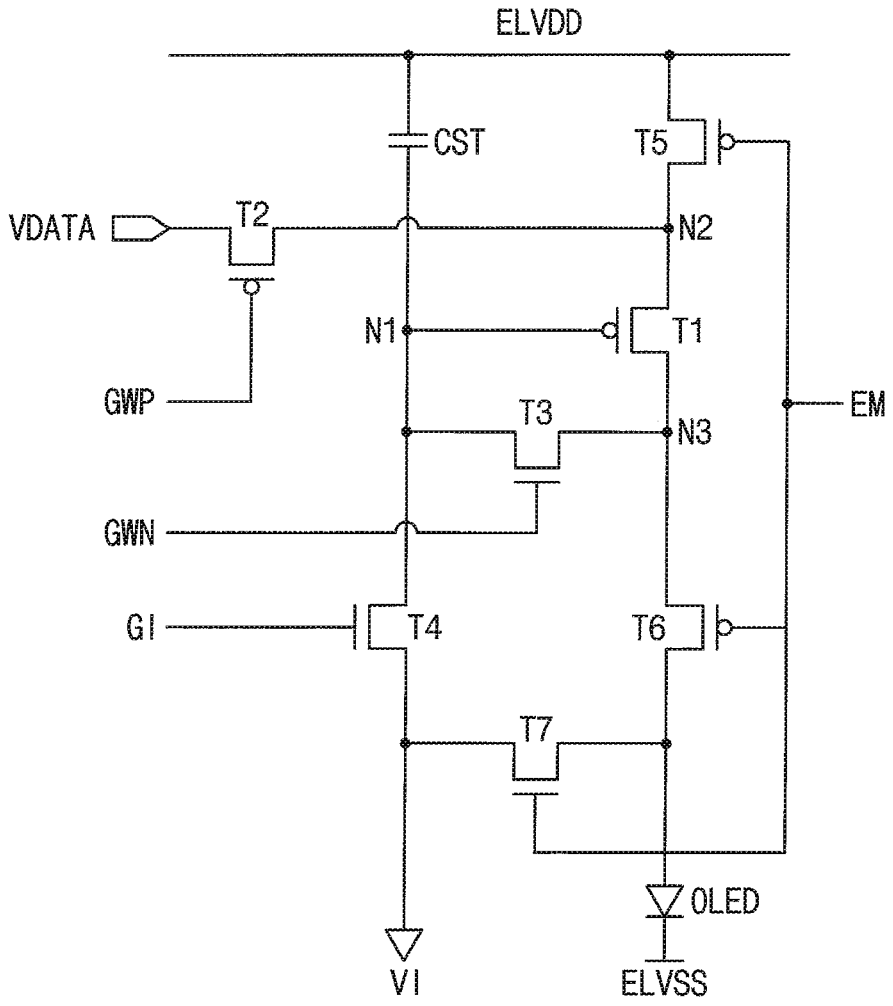
FIG. 16 is a circuit diagram illustrating a pixel of a display panel according to an example embodiment of the present inventive concept.

FIG. 16 is a circuit diagram illustrating a pixel of a display panel 100 according to an example embodiment of the present inventive concept.

The display apparatus according to the present example embodiment is substantially the same as the display apparatus of the previous example embodiment explained referring to FIGS. 1 to 7*b* except for the pixel structure. Thus, the same reference numerals will be used to refer to the same or like parts as those described in the previous example embodiment of FIGS. 1 to 7*b* and any repetitive explanation concerning the above elements will be omitted.

Referring to FIGS. 1, 3 to 7*b* and 16, at least one of the pixels may include first to seventh pixel switching elements T1 to T7, a storage capacitor CST and the organic light emitting element OLED.

The pixel structure of the present invention may be substantially the same as the pixel structure of FIG. 2 except that the control electrode of the seventh pixel switching element T7 is connected to the control electrode of the sixth pixel switching element T6.

The emission signal EM is applied to the control electrode of the seventh pixel switching element T7, which is the N-type transistor, so that the seventh pixel switching element T7 is turned on when the emission signal EM has a high level (DU1 to DU3 in FIG. 3). Therefore, the organic light emitting element OLED may be initialized.

In the present example embodiment, the emission signal EM is applied to the seventh pixel switching element T7, the organic light emitting element initialization signal GB may not be generated and the gate line for applying the organic light emitting element initialization signal GB may be omitted.

Figure 17:
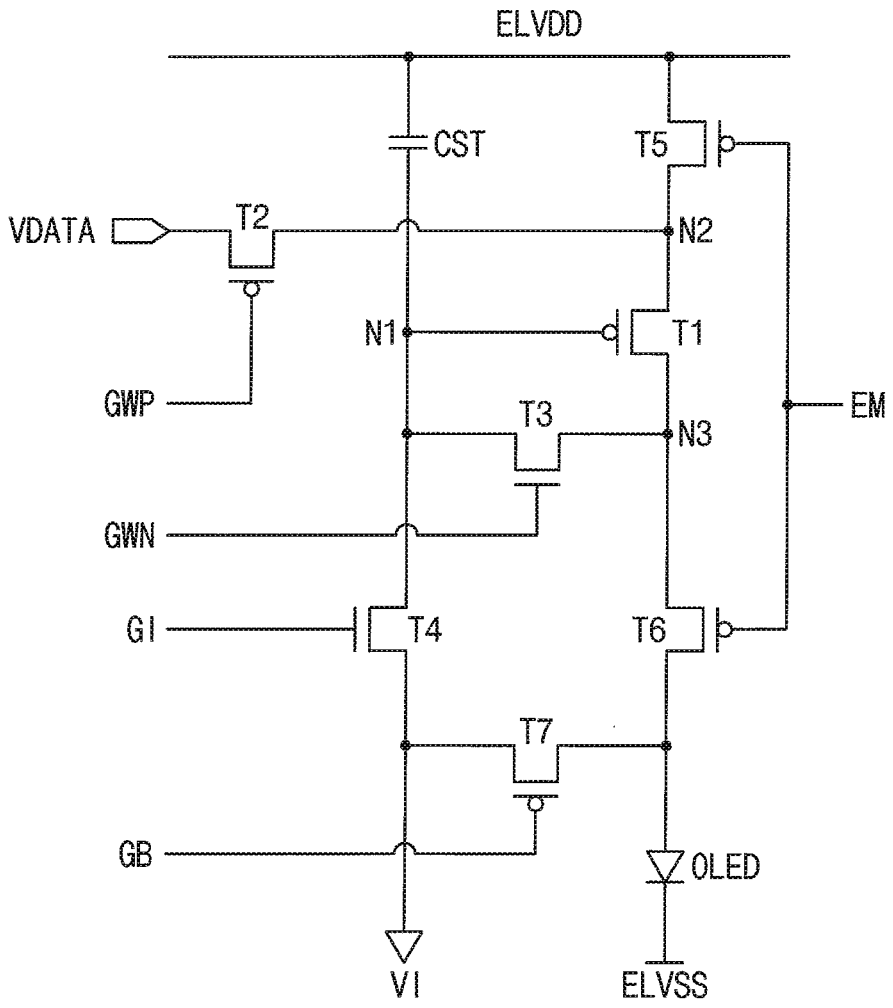
FIG. 17 is a circuit diagram illustrating a pixel of a display panel according to an example embodiment of the present inventive concept.
Figure 18:
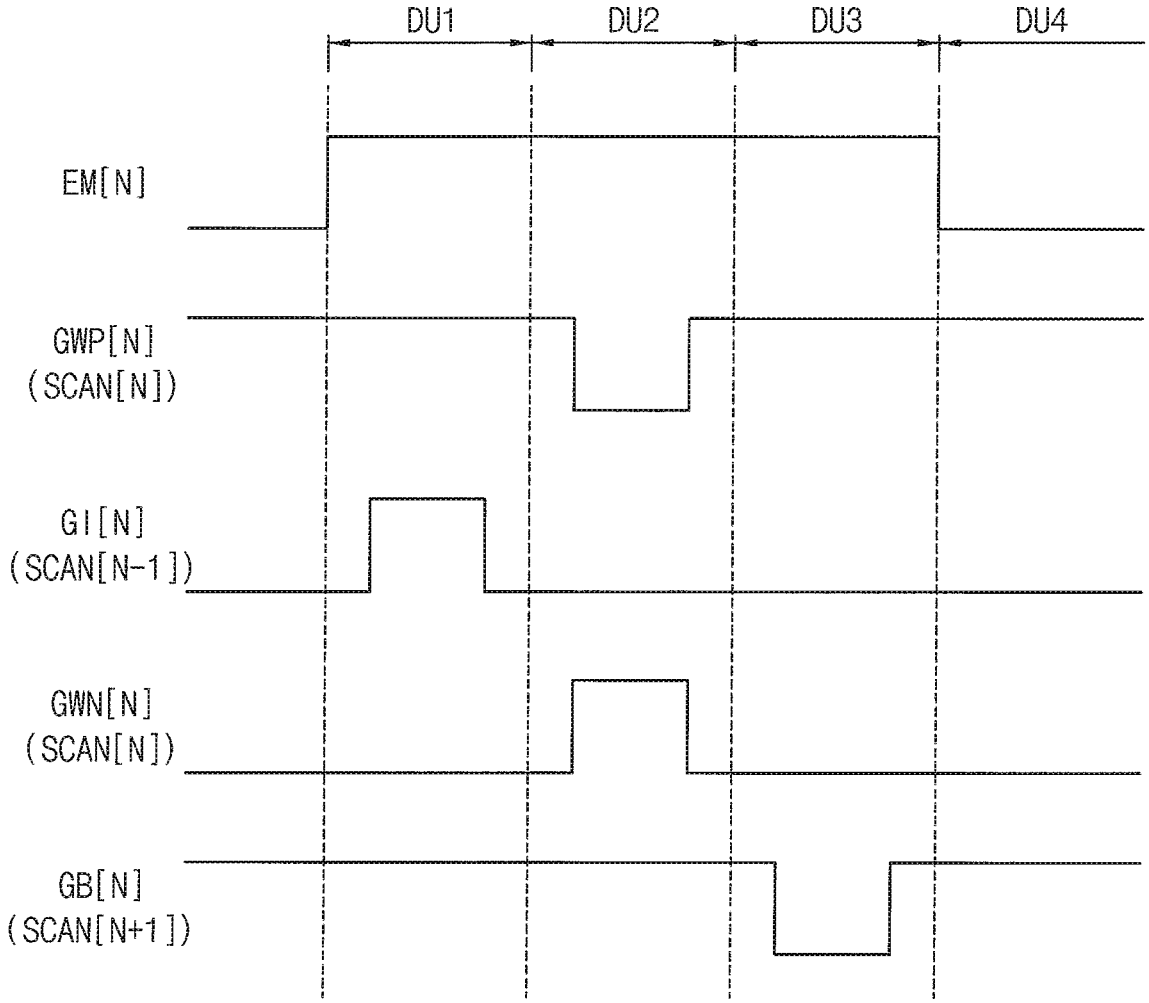
FIG. 18 is a timing diagram illustrating input signals applied to the pixel of the display panel of FIG. 17.

FIG. 17 is a circuit diagram illustrating a pixel of a display panel 100 according to an example embodiment of the present inventive concept. FIG. 18 is a timing diagram illustrating input signals applied to the pixel of the display panel of FIG. 17.

The display apparatus according to the present example embodiment is substantially the same as the display apparatus of the previous example embodiment explained referring to FIGS. 1 to 7*b* except for the pixel structure. Thus, the same reference numerals will be used to refer to the same or like parts as those described in the previous example embodiment of FIGS. 1 to 7*b* and any repetitive explanation concerning the above elements will be omitted.

Referring to FIGS. 1, 3 to 7*b* and 17 and 18, at least one of the pixels may include first to seventh pixel switching elements T1 to T7, a storage capacitor CST and the organic light emitting element OLED.

In the present example embodiment, the seventh pixel switching element T7 includes a control electrode to which the organic light emitting element initialization gate signal GB is applied, an input electrode to which the initialization voltage VI is applied and an output electrode connected to the anode electrode of the organic light emitting element.

For example, the seventh pixel switching element T7 may be the polysilicon thin film transistor. For example, the seventh pixel switching element T7 may be the P-type thin film transistor.

In FIG. 18, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the storage capacitor CST in response to the first and second data write gate signals GWP and GWN.

During a third duration DU3, the anode electrode of the organic light emitting element OLED is initialized in response to the organic light emitting element initialization gate signal GB. During a fourth duration DU4, the organic light emitting element OLED emit the light in response to the emission signal EM so that the display panel 100 displays the image.

In the present example embodiment, the active level of the organic light emitting element initialization gate signal GB may be a low level.

In the present example embodiment, some of the pixel switching elements may be designed using the oxide thin film transistors. In the present example embodiment, the third pixel switching element T3 and the fourth pixel switching element T4 may be the oxide thin film transistors. The first pixel switching element T1, the second pixel switching element T2, the fifth pixel switching element T5, the sixth pixel switching element T6 and the seventh pixel switching element T7 may be the polysilicon thin film transistors.

According to the display apparatus of the present inventive concept as explained above, the power consumption of the display apparatus may be reduced and the display quality of the display panel may be enhanced.

Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims.

What is claimed is:

1. A display apparatus comprising:

a display panel comprising a pixel which includes a switching element of a first type and a switching element of a second type different from the first type;

a gate driver configured to generate a gate signal based on a vertical start signal and a gate clock signal, and output the gate signal to the display panel;

a data driver configured to output a data voltage to the display panel; and an emission driver configured to output an emission signal to the display panel, wherein a driving frequency of the display panel is varied according to an input image, wherein the gate clock signal has an active duration having a varied length according to the driving frequency, wherein, in a low frequency driving mode, the gate clock signal swings between a high level and a low level in a writing frame when data is written to the pixel, and wherein, in the low frequency driving mode, the gate clock signal maintains the low level in a holding frame when the data written to the pixel is maintained.

2. The display apparatus of claim 1, wherein, as the driving frequency decreases, the length of the active duration of the gate clock signal increases.

3. The display apparatus of claim 2, wherein an active duration length of the vertical start signal varies according to the driving frequency.

4. The display apparatus of claim 3, wherein, as the driving frequency decreases, the active duration length of the vertical start signal increases.

5. The display apparatus of claim 2, wherein the gate signal includes a data write gate signal, and wherein an active duration length of the data write gate signal varies according to the driving frequency.

6. The display apparatus of claim 1, wherein the switching element of the first type is a polysilicon thin film transistor, and the switching element of the second type is an oxide thin film transistor.

7. The display apparatus of claim 6, wherein the switching element of the first type is a P-type transistor, and the switching element of the second type is an N-type transistor.

8. The display apparatus of claim 6, wherein the pixel comprises:

a first pixel switching element comprising a control electrode connected to a first node, an input electrode connected to a second node and an output electrode connected to a third node;

a second pixel switching element comprising a control electrode to which a first data write gate signal is applied, an input electrode to which the data voltage is applied and an output electrode connected to the second node;

a third pixel switching element comprising a control electrode to which a second data write gate signal is applied, an input electrode connected to the first node and an output electrode connected to the third node;

a fourth pixel switching element comprising a control electrode to which a data initialization gate signal is applied, an input electrode to which an initialization voltage is applied and an output electrode connected to the first node;

a fifth pixel switching element comprising a control electrode to which the emission signal is applied, an input electrode to which a high power voltage is applied and an output electrode connected to the second node;

a sixth pixel switching element comprising a control electrode to which the emission signal is applied, an input electrode connected to the third node and an output electrode connected to an anode electrode of an organic light emitting element;

a seventh pixel switching element comprising a control electrode to which an organic light emitting element initialization gate signal is applied, an input electrode to which the initialization voltage is applied and an output electrode connected to the anode electrode of the organic light emitting element; and a storage capacitor comprising a first electrode to which the high power voltage is applied and a second electrode connected to the first node, and wherein the organic light emitting element includes the anode electrode connected to the output electrode of the sixth pixel switching element and a cathode electrode to which a low power voltage is applied.

9. The display apparatus of claim 8, wherein the first pixel switching element, the second pixel switching element, the fifth pixel switching element and the sixth pixel switching element are the polysilicon thin film transistors, and wherein the third pixel switching element, the fourth pixel switching element and the seventh pixel switching element are the oxide thin film transistors.

10. The display apparatus of claim 8, wherein the first pixel switching element, the second pixel switching element, the fifth pixel switching element, the sixth pixel switching element and the seventh pixel switching element are the polysilicon thin film transistors, and the third pixel switching element and the fourth pixel switching element are the oxide thin film transistors.

11. The display apparatus of claim 6, wherein the pixel comprises:

a first pixel switching element comprising a control electrode connected to a first node, an input electrode connected to a second node and an output electrode connected to a third node;

a second pixel switching element comprising a control electrode to which a first data write gate signal is applied, an input electrode to which the data voltage is applied and an output electrode connected to the second node;

a third pixel switching element comprising a control electrode to which a second data write gate signal is applied, an input electrode connected to the first node and an output electrode connected to the third node;

a fourth pixel switching element comprising a control electrode to which a data initialization gate signal is applied, an input electrode to which an initialization voltage is applied and an output electrode connected to the first node;

a fifth pixel switching element comprising a control electrode to which the emission signal is applied, an input electrode to which a high power voltage is applied and an output electrode connected to the second node;

a sixth pixel switching element comprising a control electrode to which the emission signal is applied, an input electrode connected to the third node and an output electrode connected to an anode electrode of an organic light emitting element;

a seventh pixel switching element comprising a control electrode to which the emission signal is applied, an input electrode to which the initialization voltage is applied and an output electrode connected to the anode electrode of the organic light emitting element; and a storage capacitor comprising a first electrode to which the high power voltage is applied and a second electrode connected to the first node, and wherein the organic light emitting element includes the anode electrode connected to the output electrode of the sixth pixel switching element and a cathode electrode to which a low power voltage is applied.

12. The display apparatus of claim 1, wherein a display panel driver is configured to drive the switching element of the first type and the switching element of the second type in a high driving frequency in a high frequency driving mode, and wherein the display panel driver is configured to drive the switching element of the first type and the switching element of the second type in a low driving frequency in a low frequency driving mode.

13. The display apparatus of claim 1, wherein a display panel driver is configured to drive the switching element of the first type and the switching element of the second type in a high driving frequency in a high frequency driving mode, and wherein the display panel driver is configured to drive the switching element of the first type in the high driving frequency and the switching element of the second type in a low driving frequency less than the high driving frequency in a hybrid driving mode.

14. A display apparatus comprising:

a display panel comprising a pixel which includes a switching element of a first type and a switching element of a second type different from the first type;

a gate driver configured to generate a gate signal based on a vertical start signal and a gate clock signal, and output the gate signal to the display panel;

a data driver configured to output a data voltage to the display panel; and an emission driver configured to output an emission signal to the display panel, wherein a driving frequency of the display panel is varied according to an input image, wherein the gate clock signal has an active duration having a varied length according to the driving frequency, wherein, in a low frequency driving mode, the gate clock signal swings between a high level and a low level in a writing frame when data is written to the pixel, and wherein, in the low frequency driving mode, the gate clock signal maintains the high level in a holding frame when the data written to the pixel is maintained.

15. A display apparatus comprising:

a display panel comprising a pixel which includes a switching element of a first type and a switching element of a second type different from the first type;

a gate driver configured to output a gate signal to the display panel;

a data driver configured to output a data voltage to the display panel; and an emission driver configured to output an emission signal to the display panel, wherein a driving frequency of the display panel is varied according to an input image, the driving frequency including a first driving frequency and a second driving frequency lower than the first driving frequency, and wherein a high power voltage applied to the pixel gradually decrease during a period which is driven by the second driving frequency.

16. The display apparatus of claim 15, wherein, as the driving frequency decreases, the level of the high power voltage decreases.

17. A display apparatus comprising:

a display panel comprising a pixel which includes a switching element of a first type and a switching element of a second type different from the first type;

a gate driver configured to output a gate signal to the display panel;

a data driver configured to output a data voltage to the display panel; and an emission driver configured to output an emission signal to the display panel, wherein a driving frequency of the display panel varies according to an input image, and wherein a level of a gate on voltage defining a high level of the gate signal increases as the driving frequency decreases.

* * * * *